US008359779B2

(12) United States Patent
Daniel et al.

(10) Patent No.: US 8,359,779 B2
(45) Date of Patent: Jan. 29, 2013

(54) HAND GUARD ASSEMBLY FOR SECURELY ATTACHING TO A FIREARM

(75) Inventors: Marvin C. Daniel, Pooler, GA (US); Eric M. Rice, Rincon, GA (US)

(73) Assignee: Daniel Defense, Inc., Black Creek, GA (US)

( * ) Notice: Subject to any disclaimer, the term of this patent is extended or adjusted under 35 U.S.C. 154(b) by 290 days.

(21) Appl. No.: 12/695,615

(22) Filed: Jan. 28, 2010

(65) Prior Publication Data

US 2010/0126054 A1 May 27, 2010

Related U.S. Application Data

(63) Continuation-in-part of application No. 12/234,937, filed on Sep. 22, 2008, now Pat. No. 8,046,949.

(51) Int. Cl.
*F41A 21/00* (2006.01)

(52) U.S. Cl. ..... 42/75.03; 42/71.01

(58) Field of Classification Search ..... 42/75.03, 42/75.1, 71.01, 72, 75.01
See application file for complete search history.

(56) References Cited

U.S. PATENT DOCUMENTS 3,090,150 A * 5/1963 Stoner ..... 42/71.01
4,213,263 A 7/1980 Brouthers
4,536,982 A 8/1985 Bredbury et al.
4,571,870 A 2/1986 Heideman et al.
4,756,111 A 7/1988 Lapier
5,010,676 A 4/1991 Kennedy
5,020,260 A 6/1991 Houghton
5,198,600 A 3/1993 E'Nama
5,343,650 A 9/1994 Swan
5,433,028 A 7/1995 Novak
5,590,484 A 1/1997 Mooney et al.
5,826,363 A * 10/1998 Olson ..... 42/75.01
6,023,874 A 2/2000 Veit
6,293,040 B1 9/2001 Luth
6,490,822 B1 12/2002 Swan
6,499,245 B1 * 12/2002 Swan ..... 42/71.01
6,508,027 B1 1/2003 Kim
6,671,990 B1 * 1/2004 Booth ..... 42/75.01
6,694,660 B1 * 2/2004 Davies ..... 42/75.01
6,725,594 B2 4/2004 Hines
6,779,288 B1 8/2004 Kim
6,792,711 B2 9/2004 Battaglia
6,854,206 B2 2/2005 Oz
6,895,708 B2 5/2005 Kim et al.
6,931,775 B2 8/2005 Burnett
6,959,509 B2 * 11/2005 Vais ..... 42/75.02
6,971,202 B2 12/2005 Bender (Continued)

OTHER PUBLICATIONS

Written Opinion and International Search Report for PCT/US08/77215, mailed May 18, 2009.

(Continued)

*Primary Examiner* — Samir Abdosh
(74) *Attorney, Agent, or Firm* — Sutherland Asbill & Brennan LLP

(57) ABSTRACT

Embodiments of the invention can include a hand guard assembly for securely attaching to a firearm. According to one embodiment, a hand guard assembly can be provided for a firearm having an upper receiver and a barrel. The hand guard assembly can include a barrel nut operable to mount the barrel to the upper receiver of the firearm. The hand guard assembly can also include a hand guard having a receiving channel about an interior portion of the hand guard. The receiving channel can be sized and shaped to receive the barrel nut such that the hand guard can be secured to the barrel nut by a securing mechanism when the hand guard is positioned about the barrel of the firearm.

11 Claims, 6 Drawing Sheets

U.S. PATENT DOCUMENTS

| | | | | |
|---|---|---|---|---|
| 7,059,076 | B2 | 6/2006 | Stoner et al. | |
| 7,131,228 | B2 | 11/2006 | Hochstrate et al. | |
| RE39,465 | E | 1/2007 | Swan | |
| 7,216,451 | B1 * | 5/2007 | Troy | 42/72 |
| 7,363,741 | B2 | 4/2008 | DeSomma et al. | |
| 7,506,468 | B2 | 3/2009 | Farrell et al. | |
| 7,716,865 | B2 | 5/2010 | Daniel et al. | |
| 7,793,452 | B1 * | 9/2010 | Samson et al. | 42/72 |
| 8,046,949 | B1 * | 11/2011 | Daniel | 42/75.02 |
| 8,051,595 | B2 | 11/2011 | Hochstrate et al. | |
| 2003/0074822 | A1 | 4/2003 | Faifer | |
| 2007/0017139 | A1 | 1/2007 | Larue | |
| 2007/0261285 | A1 * | 11/2007 | Troy | 42/75.03 |
| 2009/0013579 | A1 * | 1/2009 | Fluhr | 42/71.01 |
| 2010/0095575 | A1 * | 4/2010 | Swan | 42/72 |
| 2010/0126054 | A1 * | 5/2010 | Daniel et al. | 42/71.01 |
| 2010/0175293 | A1 | 7/2010 | Hines | |
| 2010/0269392 | A1 | 10/2010 | Swan | |
| 2010/0319231 | A1 | 12/2010 | Stone et al. | |
| 2011/0061281 | A1 | 3/2011 | Kapusta et al. | |
| 2011/0192066 | A1 | 8/2011 | Kimmel et al. | |
| 2012/0005936 | A1 * | 1/2012 | Daniel | 42/71.01 |

OTHER PUBLICATIONS

International Preliminary Report on Patentability for PCT/US08/77215, mailed Feb. 23, 2010.

International Search Report for PCT/US2008/077215 mailed May 18, 2009.

* cited by examiner

HAND GUARD ASSEMBLY FOR SECURELY ATTACHING TO A FIREARM

CROSS-REFERENCE TO RELATED APPLICATION

This application is a continuation in part of U.S. patent application Ser. No. 12/234,937, filed Sep. 22, 2008, which is incorporated by reference in its entirety.

TECHNICAL FIELD

The disclosure generally relates to a hand guard for a firearm, and more particularly relates to a hand guard assembly for securely attaching to a firearm.

BACKGROUND OF THE INVENTION

Firearms such as rifles normally include a relatively elongated barrel that is gripped by a user during firearm operation. Because the barrel may become hot with repeated firing, the firearm is normally equipped with a hand guard that is positioned about an exterior surface of the barrel. During operation, the user may grip the hand guard to protect his hand from heat radiating from the barrel as rounds of ammunition are discharged.

Typically, the hand guard is secured to the firearm between a front sight base, which is used to sight the firearm, and a barrel nut, which is used to attach the barrel to the firearm. The hand guard is positioned between the front sight base and the barrel nut such that a forward end of the hand guard is inserted into a hand guard cap adjacent to the front sight base, and a rearward end is positioned about the barrel nut. A spring-loaded delta ring then extends over the rearward end to capture the hand guard against the barrel nut, securing it to the firearm. Because the hand guard is connected to the firearm at both its forward and rearward ends, the attachment may be relatively secure. Such a configuration is described in U.S. Pat. No. 3,090,150 entitled "Hand Guard Construction."

To accommodate one or more accessories, the hand guard may have a rail system. The rail system extends about an exterior of the hand guard and provides a mounting surface for attaching accessories. The upper receiver may also have rail system, but because the upper receiver is separated from the hand guard by the delta ring and barrel nut, the disparate rail systems of the upper receiver and the hand guard usually do not connect with each other. That is, the disparate rail systems do not provide a continuous mounting platform between the upper receiver and the hand guard because the mounting surfaces provided by the rail systems are interrupted. While a rail extension member can be used to connect the two rail systems, the rail extension member must be sized to extend over the barrel nut and delta ring, which alters the line of the sight for the user and results in incompatibility with certain accessories.

One problem with conventional hand guards is that such hand guards are not free-floating. A free-floating hand guard is attached to the firearm at a single point but is otherwise spaced apart from the barrel in a radial direction. The space forms an air gap about the barrel that dissipates heat. The space also provides a relief area for absorbing displacement caused by the grip of the user or the weight of an accessory, which otherwise may affect the direction of the projectile and the accuracy of the firearm. Thus, replacing a conventional hand guard with a free-floating hand guard may be generally desired. At the same time, because the free-floating hand guard is attached at only one point, the connection between the hand guard and the firearm is relatively less secure. Consequently, a free floating hand guard may not have a relatively secure connection to the firearm to permit attaching heavy accessories or withstanding expected vibration and jostling. For example, the hand guard may tend to wobble.

While some free-floating hand guards may attach more securely, such hand guards rely on a bulky attachment structure that clamps the hand guard about an outer circumferential surface of the barrel nut. These bulky attachment structures, though, may increase the height or disrupt the profile of the firearm, impeding the line of sight of the user and/or the use of a rail system.

SUMMARY OF THE INVENTION

Embodiments of the invention can include hand guard assemblies for securely attaching to a firearm. In certain embodiments, a hand guard assembly for a firearm having an upper receiver and a barrel may be provided. The hand guard assembly may include a barrel nut operable to mount the barrel to the upper receiver of the firearm. The hand guard assembly may also include a hand guard having a receiving channel about an interior portion of the hand guard. The receiving channel may be sized and shaped to receive the barrel nut such that the hand guard may be secured to the barrel nut by a securing mechanism when the hand guard is positioned about the barrel of the firearm.

In another embodiment, a method for installing a hand guard assembly on a firearm having an upper receiver and a barrel may be provided. The method may include positioning a hand guard about the barrel of the firearm such that a receiving channel about an interior portion of the hand guard receives a barrel nut. The method may also include securing the hand guard to the barrel nut.

In other embodiments, a firearm having a hand guard assembly may be provided. The firearm may include an upper receiver and a barrel, wherein the barrel is mounted to the upper receiver using a barrel nut. In addition to the barrel nut, an upper receiver, and a barrel, the firearm may include a hand guard having a receiving channel about an interior portion of the hand guard. The receiving channel may be sized and shaped to receive the barrel nut. The hand guard may also include a securing mechanism for securing the hand guard to the barrel nut when the barrel nut is received by the receiving channel.

Other features and aspects of embodiments of hand guard assemblies for securely attaching to a firearm will be apparent or will become apparent to one with skill in the art upon examination of the following figures and detailed description. All other features and aspects, as well as other system and method embodiments, are intended to be included within the description and are intended to be within the scope of the accompanying claims.

BRIEF DESCRIPTION OF THE FIGURES

The present disclosure may be better understood with reference to the following figures. Matching reference numerals designate corresponding parts throughout the figures, and components in the figures are not necessarily to scale.

DETAILED DESCRIPTION OF EMBODIMENTS

Described below are embodiments of a hand guard assembly that can be attached to a firearm. Methods of installing a hand guard on a firearm are also disclosed. In one embodiment, a hand guard assembly permits securely attaching a hand guard, including a free-floating hand guard, to the firearm without disrupting the firearm's height or profile. Thus, when secured to the firearm, the hand guard may absorb deflection when grasped. The hand guard may also tolerate vibration, jostling, and/or the weight of accessories, without wobbling or becoming separated from the firearm. The hand guard also may provide a relatively continuous mounting platform between the upper receiver and the hand guard without impeding and/or altering the user's line of sight.

In certain embodiments of the invention, the hand guard assembly may be secured to the firearm by incorporating a barrel nut having a forward lateral face, a rearward lateral face, and a longitudinal outer surface having a longitudinal depth. The longitudinal depth of the barrel nut corresponds to the longitudinal depth of a receiving channel located about an interior portion of a hand guard. To mount the hand guard to the firearm, the hand guard may be positioned about the barrel such that the barrel nut is received in the receiving channel of the hand guard. With the barrel nut received in the receiving channel, the hand guard may be secured to the barrel nut (and the firearm when the barrel nut is mounting the barrel to the upper receiver) by a securing mechanism. In one embodiment, the securing mechanism may apply a clamping force against a lateral face of the barrel nut to clamp the barrel nut between the fastener and a lateral rim of the receiving channel. In so doing, the hand guard may be mounted to the barrel nut through three mounting surfaces: the two lateral faces and the longitudinal outer surface of the barrel nut. In mounting to the barrel nut via three such mounting surfaces, the hand guard can employ multiple mounting surfaces that can facilitate secure attachment to the firearm.

In some embodiments, the hand guard assembly may be sized to form an air gap about the barrel. Such an air gap may accommodate heat dissipation and may preserve the accuracy of the firearm, such as when accessories have been attached to the hand guard via a rail assembly. In some embodiments, the hand guard assembly may be sized to provide a relatively continuous and longitudinally oriented platform, such as a rail assembly, for mounting one or more accessories between the upper receiver and the hand guard assembly. While the hand guard assembly described herein may be one or both of a free-floating hand guard and a rail system, it will be appreciated that the hand guard assembly can have other configurations, shapes, and/or sizes in accordance with the invention.

Figure 1:
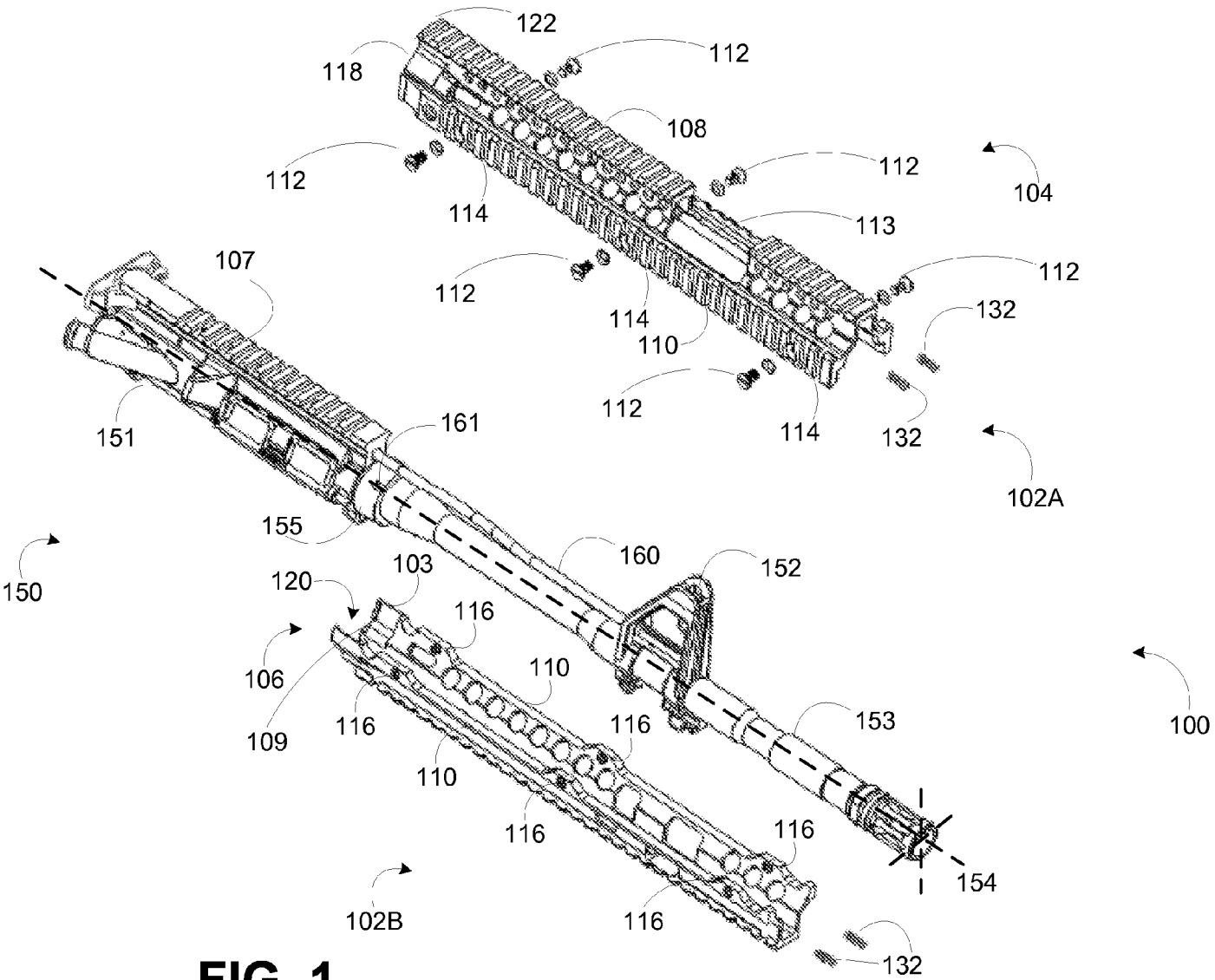
FIG. 1 is an exploded perspective view of an upper receiver and barrel of a firearm along with an example hand guard assembly adapted to be mounted to the firearm and about the barrel according to one embodiment of the invention.

FIG. 1 is an exploded perspective view of an embodiment of a hand guard assembly 100 positioned adjacent to a portion of a firearm 150, in accordance with an embodiment of the invention. The firearm 150 may be a conventional firearm. For example, the firearm 150 may be an M-16 style rifle, an AR-15 style rifle, an AR-10 style rifle, or an M-4 style rifle, among others. As shown in FIG. 1, the firearm 150 generally includes an upper receiver 151 and a barrel 153. The upper receiver 151 generally houses internal components of the firearm 150 and is not shown in detail in FIG. 1. The barrel 153 extends from the upper receiver 151 along a longitudinal axis 154 and may be secured or otherwise mounted to the upper receiver 151 using a barrel nut 155.

The barrel nut 155 is similar to a conventional barrel nut in that it secures or otherwise mounts the barrel 153 to the upper receiver 151. The barrel nut 155 may have an opening for receiving the barrel 153, and the opening may be threaded for attaching or otherwise mounting the barrel 153 to the upper receiver 151. More particularly, the threaded opening of the barrel nut 155 may engage a threaded connector portion of the upper receiver 151, capturing the barrel 153 between the barrel nut 155 and the connector portion to attach or mount the barrel 153 to the upper receiver 151. Unlike a conventional barrel nut, however, the barrel nut 155 may not have a scalloped flange about its exterior for capturing a portion of a hand guard with a delta ring. It will be appreciated that the barrel nut 155 can be provided as part of an original hand guard assembly 100 for the firearm 150, or the barrel nut 155 can be provided as part of a replacement hand guard assembly 100 for the firearm 150.

The barrel nut 155 comprises a lateral front face 157, a lateral rear face 158, and an outer surface 159 having a longitudinal depth 156. The barrel nut 155 can be configured to mate with at least a portion of an inner surface 109 of the receiving channel 103 in hand guard 102. More particularly, the barrel nut 155 can include an outer mating surface 159 that corresponds to an inner mating surface 109 of the receiving channel 103. These mating surfaces are sized and shaped to nest in relatively close proximity to each other when the barrel nut 155 is positioned in the receiving channel 103. For example, the mating surfaces may become positioned directly adjacent to each other and/or may contact each other. The nesting or mating relationship between these two components may substantially limit movement of the hand guard 102 in a radial direction. Further, the nesting or mating relationship may substantially limit rotation of the hand guard 102 about the barrel nut 155 in a longitudinal direction, such that the hand guard 102 is less likely to wobble or rock about the barrel nut.

Figure 2:
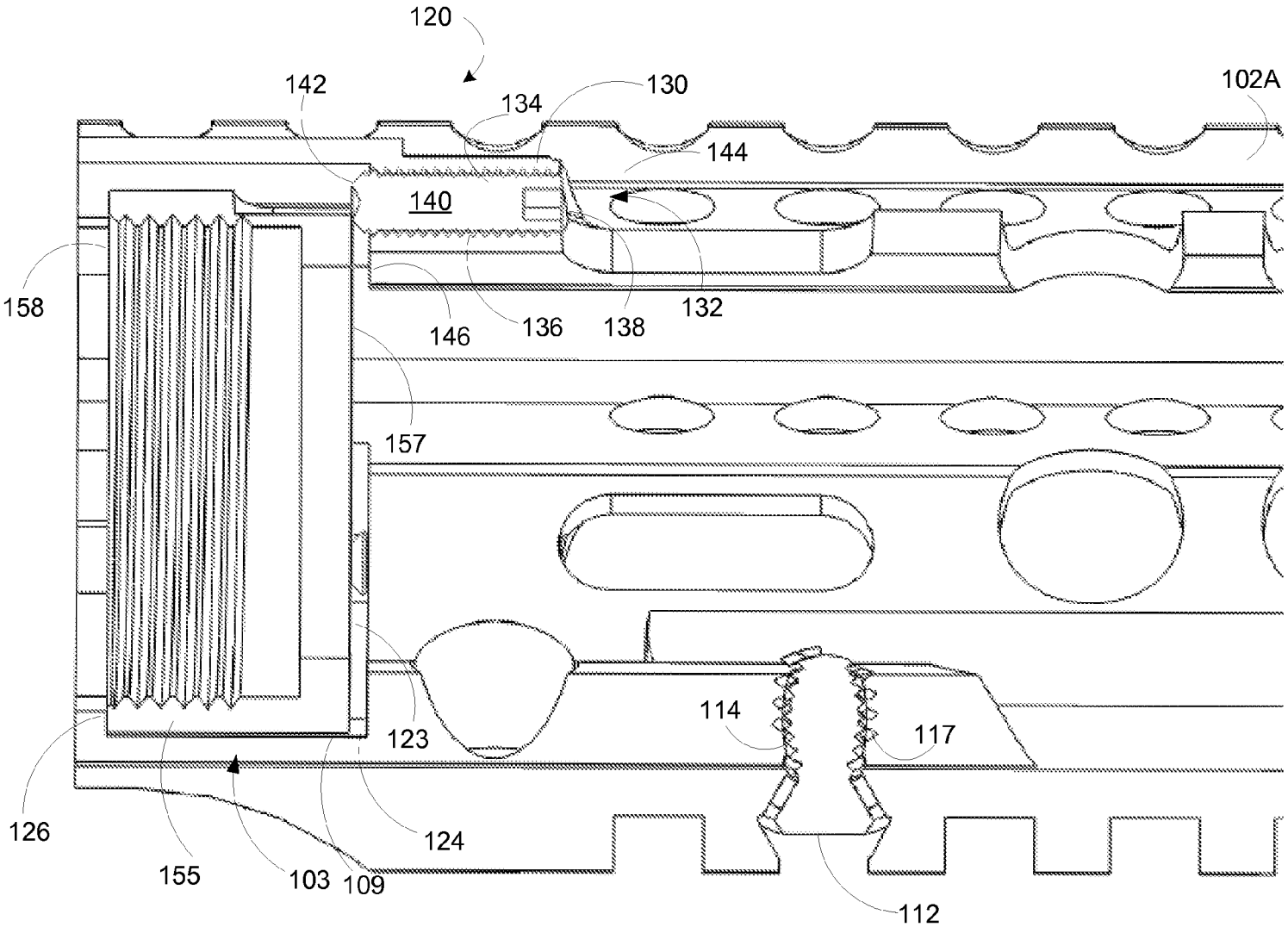
FIG. 2 is a partial cross-sectional view of an example hand guard assembly illustrating a securing mechanism according to one embodiment of the invention.

In certain embodiments, the outer mating surface 159 may comprise an entire or substantial portion of the exterior surface of the barrel nut 155. In the illustrated embodiment, for example, the entire or substantial portion of the exterior cylindrical surface of the barrel nut 155, with the exception of notches 161, can constitute or otherwise comprise the outer mating surface 159, which can nest in relatively close proximity to the inner cylindrical surface 109 of the receiving channel 103 as shown in FIG. 2. Thus, when the barrel nut 155 is in the receiving channel 103, substantially all of the outer surface 159 of the barrel nut is positioned adjacent to the receiving channel 103. Such a configuration may facilitate securely connecting or otherwise mounting the hand guard 102 to the firearm 150 about the barrel nut 155. It will be appreciated that the mating surfaces may have many configurations in accordance with other embodiments of the invention. For example, any exterior portion of the barrel nut 155 may constitute a suitable mating surface that nests or mates with any corresponding portion of the receiving channel 103 depending on the sizes and shapes of the mating surface and corresponding portion of the receiving channel. One may appreciate that, in certain embodiments, increasing the size and/or altering the shape of the mating surfaces may increase the security of the connection between the hand guard 102 and the barrel nut 155.

Figure 3:
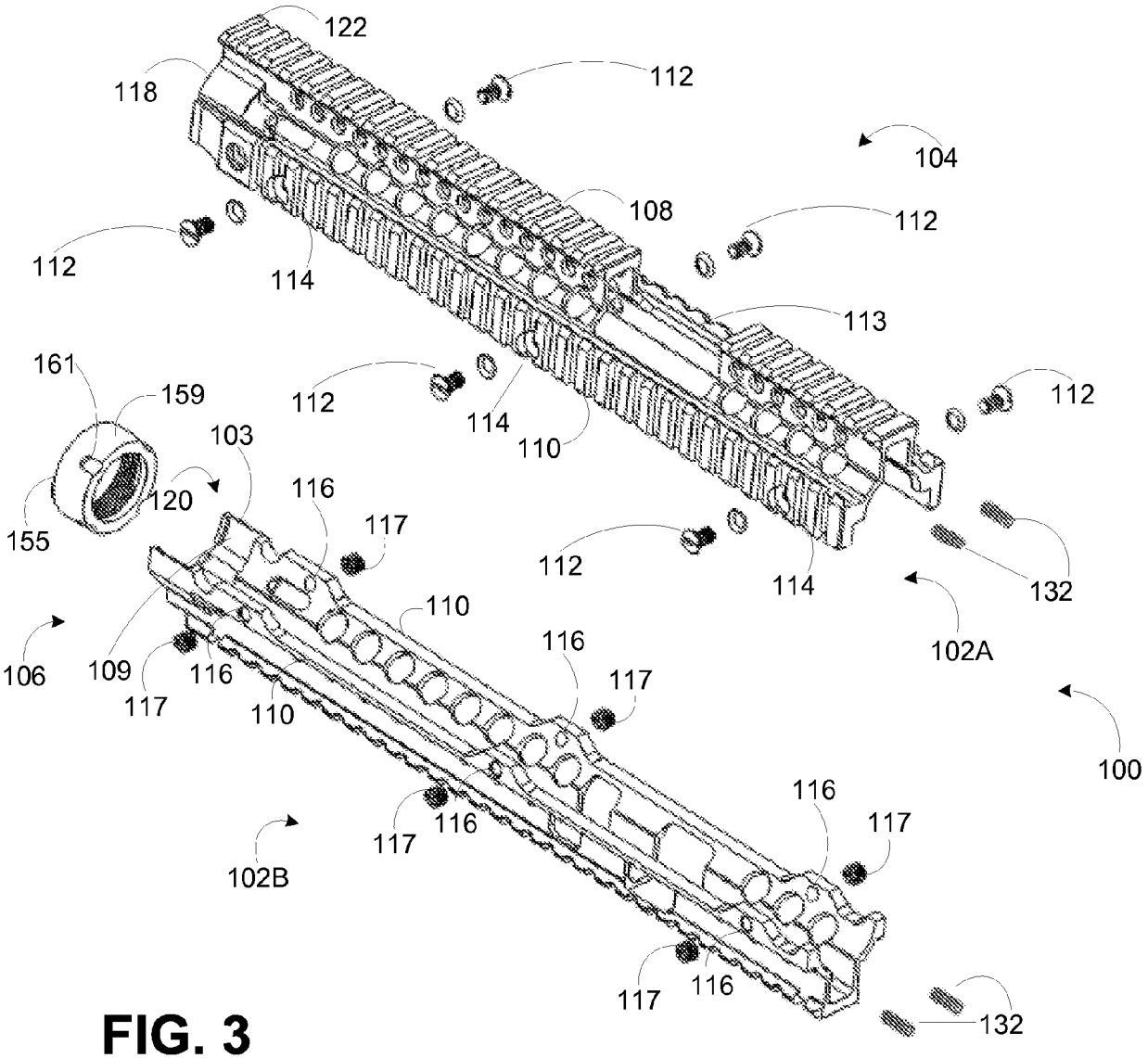
FIG. 3 is an exploded perspective view of a barrel nut, an upper hand guard member, and a lower hand guard member according to one embodiment of the invention.
Figure 5:
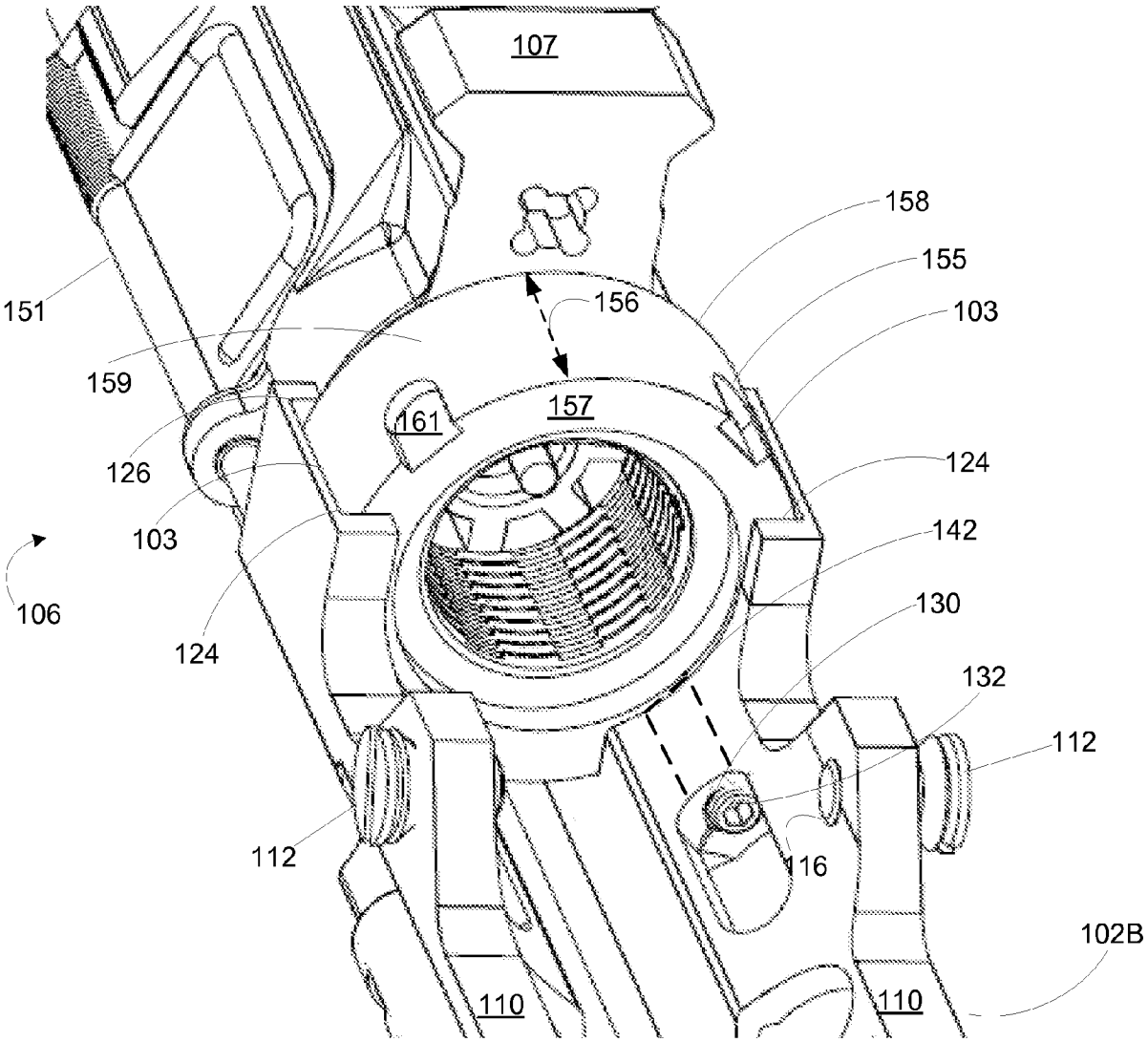
FIG. 5 is an exploded perspective view of an example hand guard assembly including a barrel nut mounted to an upper receiver and resting within the annular groove of a lower hand guard member according to one embodiment of the invention.

An example is shown in FIG. 3, which illustrates the barrel nut 155 as having a cylindrically-shaped outer surface 159. The cylindrically-shaped outer surface 159 may be suited for nesting in or mating with an annularly shaped receiving channel 103 in the hand guard 102, as shown in FIG. 5. The barrel nut 155 may be narrower in a longitudinal direction and in a radial direction than a conventional barrel nut, which may permit encapsulating the barrel nut 155 completely or partially within the hand guard 102 without increasing the height of the hand guard 102 or changing its profile, as shown in FIG. 2. In other words, the barrel nut 155 may fit wholly, completely, or partially in the receiving channel 103 so that the receiving channel 103 completely or partially encapsulates the barrel nut 155.

Because the hand guard 102 can wrap about the barrel nut 155, the hand guard 102 can extend to abut against the upper receiver 153. Thus, a rail 108 on an exterior of the hand guard 102 can adjoin to a rail 107 on the upper receiver 153 to form a relatively continuous mounting platform. A continuous mounting platform can provide certain features to a user desiring to mount one or more accessories to firearm 150. For instance, a continuous mounting platform may accommodate larger accessories, such as an elongated optical scope, that neither mounting platform provided as part of upper receiver 151 or hand guard member 102 may accommodate alone. A configuration of hand guard assembly 100 including a continuous mounting platform is possible partly due to the absence of the delta ring, which is no longer needed to attach or mount the hand guard 102 to the firearm 150 in certain embodiments of the invention.

Barrel nut 155 may have any shape or any number of features according to embodiments of the invention. For example, in one embodiment, barrel nut 155 may have a hexagonal shape rather than a circular shape as shown in the illustrated embodiment. A hexagonal shape may be associated with limiting the rotational movement of the hand guard 102 while also accommodating one or more tools for firearm assembly. In such embodiments, the receiving channel 103 may have a shape that corresponds at least in part to the barrel nut 155 so that the barrel nut can be encapsulated therein. In some embodiments, barrel nut 155 may also incorporate a scalloped flange, which may be used to secure a gas tube 160. In such embodiments, the receiving channel 103 may have a groove or other feature for accommodating the scalloped flange. In the illustrated embodiment, the barrel nut 155 does not include a scalloped flange. Without a scalloped flange, barrel nut 155 may be adapted to allow a gas tube 160 to be positioned about the barrel nut 155 when being mounted to a forward portion of the barrel 153 and to the upper receiver 151. In allowing the gas tube 160 to be positioned about the barrel nut 155 rather than as part of a scalloped flange, barrel nut 155 may reduce stresses induced on the gas tube 160 associated with multiple mounting points. Other shapes and features of the barrel nut 155 are also possible according to other embodiments.

For example, the barrel nut 155 may be further adapted to include one or more features for receiving a spanner wrench or other tool for mounting the barrel nut 155 to the upper receiver 151 and for removing the barrel nut 155 from the upper receiver 151. One such feature could be associated with the shape of barrel nut 155. A hexagonal shape, for example, may accommodate a general purpose or adjustable wrench for mounting and removing the barrel nut 155. Another such feature could be associated with the inclusion of a scalloped flange for receiving a special purpose tool, like a barrel wrench. In the illustrated embodiment, the barrel nut 155 includes multiple notches 161 for receiving portions of a spanner wrench. The notches 161 are illustrated as oval-like indentations in the longitudinal outer surface 159 of barrel nut 155 extending from the lateral front face 157 towards the lateral rear face 158. The notches 161 are illustrated as being four in number, but it will be appreciated that any number could be used according to the tool employed or the desired configuration.

Figure 4:
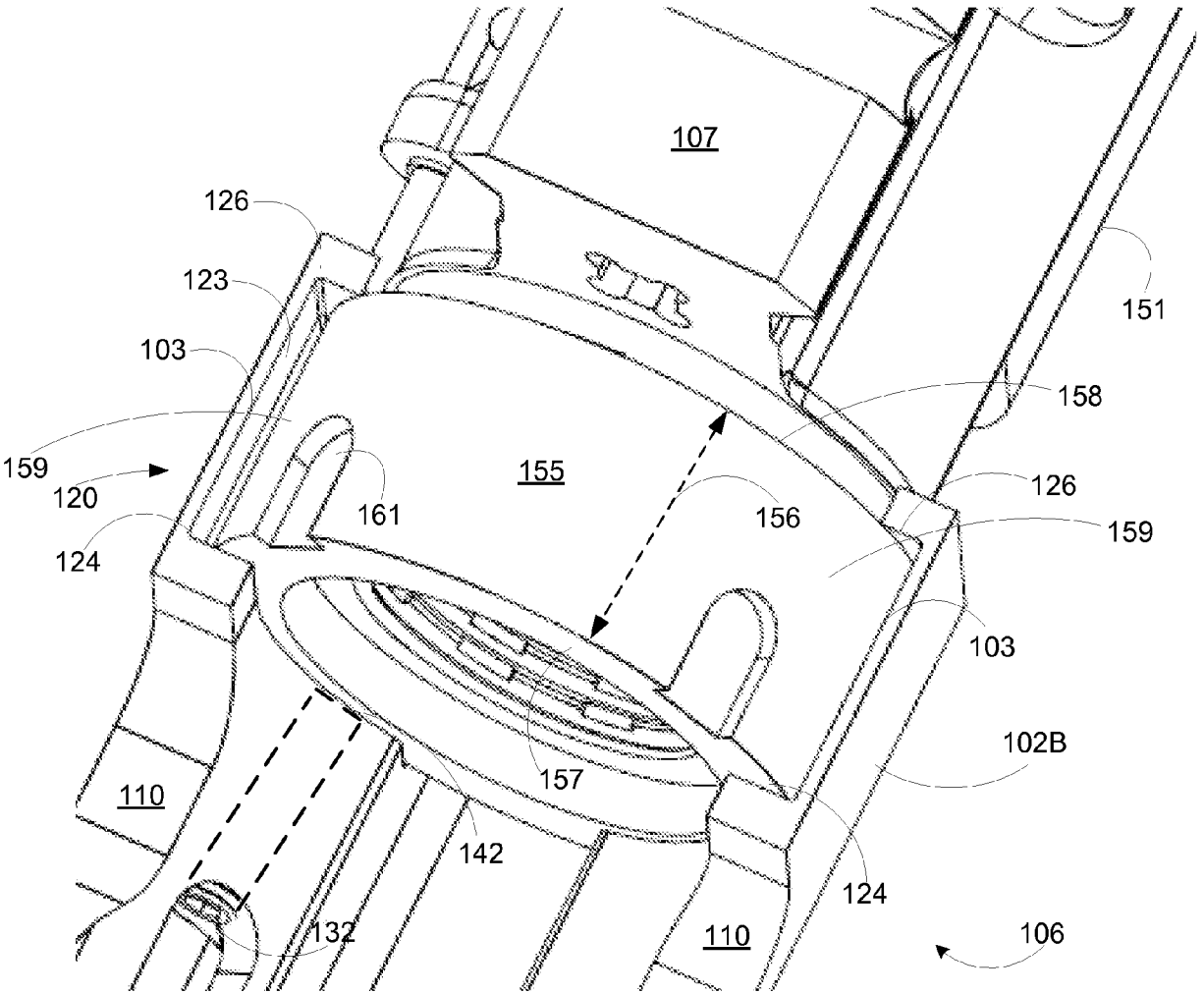
FIG. 4 is an exploded upper perspective view of portions of an example hand guard assembly including a barrel nut mounted to an upper receiver and resting within the annular groove of a lower hand guard member according to one embodiment of the invention.

In addition to the barrel nut 155, the hand guard assembly 100 generally includes the hand guard 102. The hand guard 102 may include one or more hand guard members 102A and 102B and a coupling mechanism 104. The hand guard members 102A and 102B may be positioned about the barrel 153 of the firearm 150, and the coupling mechanism 104 may couple the hand guard members 102A and 102B together to form the hand guard 102. The hand guard assembly 100 may also include a securing mechanism 106, which may secure or otherwise mount the hand guard to the firearm 150, such as by securing or mounting the hand guard 102 to the barrel nut 155. Alternative perspective views showing one or more portions of the hand guard members 102A and 102B, the coupling mechanism 104, and the securing mechanism 106 are shown in FIG. 3 through FIG. 5.

As previously indicated, the hand guard 102 includes a receiving channel 103 about an interior portion of the hand guard 102 for receiving the barrel nut 155. In the illustrated embodiment, either one or both of hand guard members 102A and 102B may include all or a portion of the receiving channel 103. The receiving channel 103 can be configured to mate with at least a portion of the barrel nut 155 to limit the movement of the hand guard 102 in relation to the firearm 150 in one or more directions. For example, as shown in the illustrated embodiment of FIG. 2, the receiving channel 103 may have a longitudinal depth 156 corresponding to the longitudinal depth of outer surface 159 of the barrel nut 155 for receiving the barrel nut 155. Thus, when the barrel nut 155 is received in the receiving channel 103, the longitudinal outer surface 159 of the barrel nut 155 is nested in relatively close proximity to the inner mating surface 109 of the receiving channel 103, which limits movement of the hand guard 102 in a radial direction. Similarly, as shown in the illustrated embodiments of FIG. 4 and FIG. 5, the receiving channel 103 may include a forward lateral rim 124 and a rearward lateral rim 126. The forward lateral rim 124 is configured to extend about a portion of the lateral front face 157; the rearward lateral rim 126 is configured to extend about a portion of the lateral rear face 158. In so doing, the forward lateral rim 124 and the rearward lateral rim 126 limit movement of the hand guard 102 in a longitudinal direction.

Each of the hand guard members 102A and 102B may be shaped to shield at least a portion of the barrel 153. For example, each hand guard member 102A and 102B may be shaped to extend along a portion of a length of the barrel 153 in the longitudinal direction generally coincident with the longitudinal axis 154, and to extend about at least a portion of the circumference of the barrel 153, in a radial direction substantially perpendicular to the longitudinal axis 154. When combined, the hand guard members 102A and 102B may extend around some or all of the circumference of the barrel 153 to shield some or all of the circumference of the barrel 153. It will be appreciated that while the example embodiment of the invention shows the lower hand guard member 102B encapsulating a bottom portion of the barrel nut 155; in other embodiments, the lower hand guard member 102B need not be so positioned.

In the embodiment shown in FIG. 1, the hand guard assembly 100 may include a hand guard 102 having the two hand guard members 102A and 102B. As shown, the hand guard members 102A and 102B may include an upper hand guard member 102A that is to be positioned above the barrel 153, and a lower hand guard member 102B that is to be positioned below the barrel 153. Each hand guard member 102A and 102B may be sized and shaped to shield about one-half of the circumference of the barrel 153 so that together the hand guard members 102A and 102B shield a substantial portion of the circumference of the barrel 153. In other embodiments, the hand guard members, when combined, may not shield a substantial portion of the circumference of the barrel 153. Further, in other embodiments, one hand guard member may shield more or less of the barrel 153 than the other hand guard member. For example, the upper hand guard member 102A is shown as shielding less of barrel 153 than the lower hand guard member 102B since the upper hand member 102A is adapted to accommodate the front sight base 152 through the port 113. It will be appreciated that while the upper hand guard member 102A is shown as accommodating an existing front sight base 152, the upper hand guard member 102A need not be so configured.

As shown in the example embodiment, the hand guard 102 may be sized so that an interior surface of the hand guard 102 is spaced apart from the barrel 153 when the hand guard 102 is positioned adjacent to the barrel 153. More specifically, the hand guard 102 may have relatively larger dimensions in the radial direction than a corresponding portion of the barrel 153. Such sizing may permit an air gap to form between the hand guard 102 and the barrel 153 so that the barrel 153 may be free-floating. Permitting the barrel 153 to free float may preserve the shooting accuracy of the firearm 150 and may protect sensitive components integrated into or mounted onto the hand guard 102. In other embodiments, the hand guard 102 may not be sized to be spaced apart from the barrel 153, but may envelope or nest in close proximity with the barrel 153.

The hand guard 102 may include a rail 108. Therefore, the hand guard assembly 100 may include a rail assembly configured for mounting one or more accessories (not shown) to the firearm 150. In other embodiments, the rail 108 may be provided on less than all of the hand guard 102. In still other embodiments, the hand guard assembly 100 may not include a rail assembly, in which case the rail 108 may be omitted from the hand guard 102 completely.

It should be noted that directional terms are provided for the purposes of illustration and are not intended to limit the disclosure. Further, the directional terms generally describe the relative position of a component when the component is positioned on the firearm 150, and the firearm 150 is positioned in the intended orientation. For example, the term "upper" generally denotes the relative position of the upper hand guard member 102A when the firearm 150 is held in the intended orientation, while the term "lower" generally denotes the relative position of the lower hand guard member 102B when the firearm 150 is held in the intended orientation. Orienting the hand guard members 102A and 102B as indicated by such directional terms may be relevant in cases in which one or more of the hand guard members 102A and 102B includes a rail 108 for mounting accessory devices. Otherwise, the hand guard members 102A and 102B may be positioned in any orientation about the barrel 153 of the firearm 150. Further, the term "forward" generally denotes a direction facing away from the upper receiver 151 and facing toward the muzzle end of the firearm 150, while the term "rearward" generally denotes a direction facing away from the muzzle end of the firearm 150 and facing toward the upper receiver 151.

As mentioned above, when hand guard 102 comprises more than one member, the coupling mechanism 104 may couple at least some of the hand guard members 102A and 102B together to form the hand guard 102. For example, the coupling mechanism 104 may couple hand guard member 102A to adjacent hand guard member 102B, such that the hand guard members 102A and 102B form a relatively continuous hand guard that encloses at least a portion of the circumference of the barrel 153. In embodiments such as the one illustrated, each hand guard member 102A and 102B may have two longitudinal edges 110, and the coupling mechanism 104 may be configured to couple each longitudinal edge 110 to an adjacent longitudinal edge 110 on an adjacent hand guard member. For example, each longitudinal edge 110 of the upper hand guard member 102A may be coupled to one of the longitudinal edges 110 of the lower hand guard member 102B in the illustrated embodiment.

In other embodiments, the coupling mechanism 104 may be configured to couple the hand guard members 102A and 102B together other than at the longitudinal edges 110. Additionally, the coupling mechanism 104 may not be configured to couple the hand guard member 102A to the adjacent hand guard member 102B. Instead, the coupling mechanism 104 may be configured to couple some of the adjacent hand guard members 102A and 102B together but not others. In still other embodiments, the coupling mechanism 104 may be omitted completely, in which case the hand guard members 102A and 102B may not be coupled together.

The coupling mechanism 104 may include a number of fasteners 112, such as a set screw. For each fastener 112, one of the hand guard members 102A and 102B may have a passage 114 and one of the other hand guard members 102A and 102B may have a corresponding threaded coupling 116. When the hand guard members 102A and 102B are positioned adjacent to each other, the passages 114 and the threaded couplings 116 may align so that one of the fasteners 112 can be placed through the passage 114 on the hand guard member 102A and into the threaded coupling 116 on the hand guard member 102B. The passages 114 and the threaded couplings 116 may be relatively evenly distributed about the hand guard members 102 so that the fasteners 112 may create a relatively uniform and secure connection.

In the illustrated embodiment, the passages 114 and the threaded couplings 116 are positioned along the longitudinal edges 110 of the hand guard members 102A and 102B, with the passages 114 being formed through the upper hand guard member 102A and the threaded couplings 116 being positioned on the lower hand guard member 102B. In other embodiments, the configuration could be reversed in whole or in part.

In the illustrated embodiment, six passages 114 and six threaded couplings 116 are provided on the upper and lower hand guard members 102A and 102B, respectively. These passages 114 and threaded couplings 116 are relatively evenly distributed on a forward left side, a forward right side, a rearward left side, and a rearward right side of the longitudinal edges 110. Such relatively even distribution can facilitate creating a relatively secure and uniform connection between the two hand guard members 102A and 102B. However, a range of other configurations are possible. Any number of fasteners 112 can be employed at any position along the hand guard members 102A and 102B, and therefore any number and position of corresponding passages 114 and threaded couplings 116 may be formed through the hand guard members 102A and 102B. Additionally, fasteners 112 other than screws can be used, in which case the passages 114 and threaded couplings 116 may be omitted or altered as appropriate. For example, the hand guard members 102A and 102B may have pressure fittings or snap fittings that are designed to mate with each other.

The coupling mechanism 104 may be configured to be releasable so that the hand guard members 102A and 102B can be uncoupled if desired. For example, in the illustrated embodiment the hand guard may be disassembled by removing the fasteners 112 from the passages 114 and the threaded couplings 116. However, the coupling mechanism 104 may not be releasable in other embodiments, or the coupling mechanism 104 may be releasable in other manners.

The coupling mechanism 104 may also be configured to withstand vibration, such as during rapid and/or sustained fire of the firearm or jostling of the firearm during transport. In one embodiment, vibration resistance may be provided through one or more threaded attachments. For example, vibration resistance may be provided by one or more threaded inserts 117. The threaded inserts 117 may be manufactured from metallic material—such as steel, stainless steel, nickel, zinc—from composite materials, or from any combination of the above. In one embodiment, the threaded inserts 117 may be mounted within the couplings 116. Couplings 116 may be adapted to receive the threaded inserts 117, and threaded inserts 117 may be adapted to receive the fasteners 112.

As mentioned above, the securing mechanism 106 may be configured to secure or otherwise mount the hand guard 102 to the firearm 150. To illustrate with reference to the illustrated embodiments, each of the hand guard members 102A and 102B may be secured or otherwise mounted to the firearm 150 using the securing mechanism 106. Although so illustrated, it will be appreciated that in other embodiments, less than all of the hand guard members 102A and 102B may be secured or mounted to the firearm 150 using the securing mechanism 106. For example, two hand guard members 102A and 102B otherwise attached or mounted to each other via a coupling mechanism 104 may be secured or mounted to the firearm 106 using a securing mechanism 106 associated with one of the hand guard members 102A or 102B.

In embodiments, the securing mechanism 106 may include at least one connector 118 and at least one clamping device 120. The connector 118 may associate the hand guard 102 with the firearm 150, and the clamping device 120 may clamp the connector 118 to the firearm 150. In embodiments, the connector 118 may associate the hand guard 102 about the barrel nut 155 of the firearm 150, and the clamping device 120 may clamp the connector 118 about the barrel nut 155, thereby securing or mounting the hand guard member 102 to the firearm 150.

The clamping device 120 may be adapted to clamp at least a portion of the connector 118 against and/or about a portion of the barrel nut 155. For example, in one embodiment, the clamping device 120 may apply a clamping force to the connector 118 and the barrel nut 155. The clamping force may be applied in a direction that is generally parallel to the longitudinal axis 154 of the barrel 153. In the illustrated embodiment, the clamping device 120 may be adapted to force the barrel nut 155 against the rearward lateral rim 126 of the connector 118 such that the connector 118 of the hand guard 102 remains securely positioned or mounted about the barrel nut 155. Thus, the hand guard 102 may be secured or mounted to the barrel nut 155 via the connector 118.

Such a configuration is shown in FIG. 2, which is a partial cross-sectional view of the hand guard assembly 100 illustrating an embodiment of the connector 118 and the clamping device 120 of the securing mechanism 106. For the purposes of example, the upper hand guard member 102A is illustrated and oriented such that the upper receiver (not shown) is on the left side of the page and the barrel (not shown) extends off of the right side of the page. The upper hand guard member 102A is shown comprising a portion of the receiving channel 103. The receiving channel 103 is characterized by a longitudinal depth that is slightly larger than the longitudinal depth 156 of the barrel nut 155. Thus, when the barrel nut 155 is nested in receiving channel 103, a clearance 123 surrounds the forward lateral face 127 and the rearward lateral face 128 of the barrel nut 155.

The clamping device 120 may include a threaded opening 130 formed through the forward rim 124 of the connector 118, and a set screw 132 positioned in the threaded opening 130. The threaded opening 130 may have threads 134 on an interior cylindrical surface. When the connector 118 is positioned about the barrel nut 155, a central axis of the threaded opening 130 may be generally parallel to the longitudinal axis 154 of the barrel 153.

The set screw 132 may be positioned in the threaded opening 130. The set screw 132 may have a head 138, a threaded shaft 140, and a tip 142. The head 138 of the set screw 132 may be on a forward side 144 of the forward lateral rim 124. The tip 142 of the set screw 132 may be positioned on a rearward side 146 of the forward rim 124 between the forward rim 124 and the barrel nut 155. Threads 136 on the threaded shaft 140 may engage the threads 134 on the interior cylindrical surface of the threaded opening 130. The threaded shaft 140 may extend in a direction that is generally parallel to the longitudinal axis 154 of the barrel 153.

To secure or mount the hand guard member 102 to the firearm 150, the set screw 132 may be rotated in the threaded opening 130. Rotation of the set screw 132 through the threaded opening 130 may cause the set screw 132 to translate in a direction generally parallel to the longitudinal axis 154 of the barrel 153. Initially, the set screw 132 may translate with respect to the threaded opening 130 and with respect to the barrel nut 155, but as the set screw 132 translates rearward and toward the upper receiver 151, the tip 142 of the set screw 132 may contact a lateral forward face 157 of the barrel nut 155. Thereafter, the set screw 132 may impart a force on the lateral forward face 157 of the barrel nut 155, and the barrel nut 155 may exert a return force on the set screw 132. The return force may impede the set screw 132 from translating rearward with respect to the barrel nut 155. Thus, with continued rotation of the set screw 132, the threaded opening 130 may begin translating forward along the threaded shaft 140 of the set screw 132, causing the connector 118 and therefore the entire hand guard member 102A to translate forward. The forward movement of the connector 118 may cause the rearward rim 126 of the connector 118 to catch against the lateral rearward face 128 of the barrel nut 155, so that the barrel nut 155 is pinned between the tip 142 of the set screw 132 and the rearward rim 126 of the connector 118. Thus, in the illustrated embodiment, the set screw 132 compensates for the width of the clearance 123 so that the barrel nut 155 is impeded or prevented from moving longitudinally in the receiving channel 103. In other embodiments, the configuration described in relation to FIG. 2 may be reversed such that set screw 132 may pin the barrel nut 155 against the forward lateral rim 124 of the receiving channel 103.

The clamping device 120 may create a relatively uniformly distributed force on the barrel nut 155. For example, the threaded openings 130 may be relatively symmetrically distributed on the hand guard members 102A and 102B. As shown in FIG. 1, two threaded openings 130 may be formed through the upper hand guard member 102A, and two threaded openings 130 may be formed through the lower hand guard member 102B. The threaded openings 130 may be symmetrically distributed on opposite longitudinal edges 110 of the hand guard members 102A and 102B, and corresponding set screws 132 may be positioned in the threaded openings 130. Thus, in the embodiment illustrated in FIG. 1, each hand guard member 102A and 102B may be clamped to the barrel nut 155 in two separate places.

In other embodiments, the clamping device 120 may have other configurations. For example, any number or alternative positioning of the clamping devices 120 may be used. Further, the clamping devices 120 may not be set screws 132 that travel through threaded housings 130 in the hand guard 102. Also, any number or alternative positioning of the connectors 118 may be used. In the illustrated embodiment, each hand guard member 102A and 102B may have a connector 118 located on the rearward transverse edge 122, while in other embodiments either of the hand guard members 102A or 102B may not have a connector 118. In such embodiments, the coupling mechanism 104 may couple either hand guard member that does not have a connector 118 to another hand guard member that does have a connector 118.

The securing mechanism 106 may be configured to be releasable so that the hand guard 102 can be removed from the barrel nut 155 if desired. For example, the set screws 132 may be removed from the threaded openings 130 in the illustrated embodiment. However, the securing mechanism 106 may not be releasable in other embodiments, or the securing mechanism 106 may be releasable in other manners.

Figure 6:
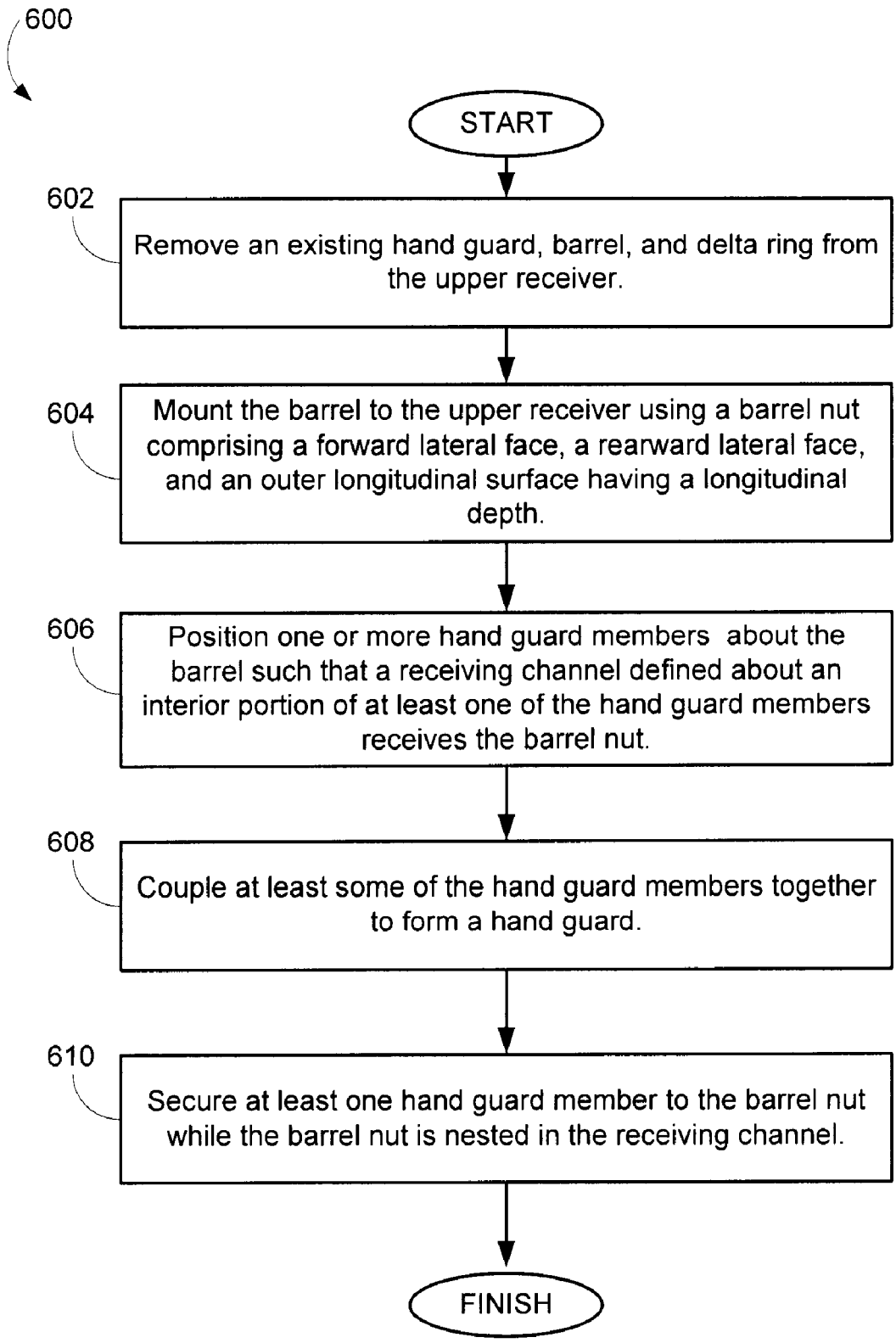
FIG. 6 is a block diagram illustrating a method for installing a hand guard on a firearm, in accordance with an embodiment of the invention.

FIG. 6 is a block diagram illustrating an embodiment of a method 600 for installing a hand guard assembly 100 on a firearm 150. Generally, a firearm 150 may include a barrel 153, and in some embodiments an existing hand guard coupled to the barrel 153 via a delta ring. More specifically, the existing hand guard may be positioned between a barrel nut having a flange and the delta ring. The existing hand guard may mate with the flange of the barrel nut, and the delta ring may extend over a portion of the existing hand guard to generally retain the existing hand guard in place.

The method 600 may include block 602 where an existing hand guard, the barrel, an existing barrel nut incorporating a flange, and a delta ring may be removed. Removing the existing hand guard may include retracting a delta ring away from the existing barrel nut. Retracting the delta ring may comprise moving the delta ring from an extended position, in which the delta ring extends over a portion of the existing hand guard, to a retracted position, in which the delta ring does not extend over the existing hand guard. In embodiments in which the delta ring is spring operated, retracting the delta ring may comprise moving the delta ring from a rest position, in which the delta ring is at rest, to a retracted position, in which the spring of the delta ring is loaded. In the retracted position, the delta ring may return to the rest position unless a force is applied to retain the delta ring in the retracted position. In such embodiments, retracting the delta ring away from the existing barrel nut may further include applying a force to retain the delta ring in the retracted position. For example, the delta ring may be manually retained in the retracted position using a hand of the user.

Once the delta ring is retracted, removing the existing hand guard may depend on the configuration of the existing hand guard. For example, the existing hand guard may include several pieces, in which cases removing the existing hand guard may comprise separating the several pieces and lifting the several pieces from the existing barrel nut. In other cases, removing the existing hand guard may comprise sliding the existing hand guard off of the existing barrel nut and along the barrel of the firearm. In other embodiments, the firearm may not include an existing hand guard, meaning that removal of an existing hand guard may be unnecessary. In some embodiments, the firearm may also include a gas tube that runs along the length of the barrel and is retained by one or more flanges of the existing barrel nut. Prior to removing the barrel, the existing barrel nut having a flange, and the delta ring from the firearm, removing the gas tube may include disengaging the gas tube from the existing barrel nut and a forward portion of the firearm. Removing the barrel, the existing barrel nut, and the delta ring may comprise engaging the flange of the existing barrel nut with a tool, such as a barrel wrench, before manipulating the existing barrel nut away from contact with the upper receiver.

Method 600 can proceed at block 604 where the barrel can be mounted to the upper receiver using barrel nut having a forward lateral face, a rearward lateral face, and an outer longitudinal surface like the barrel nut 155. The barrel nut 155 can mount over a portion of the barrel and rotatably to the upper receiver. The barrel nut may include one or more features for receiving a tool, such as a spanner wrench, to accommodate rotatably mounting the barrel nut to the upper receiver. In such embodiments, the barrel nut can be engaged by said spanner wrench or tool and rotated about a threaded end of the upper receiver.

In embodiments where the firearm includes a gas tube, mounting the barrel to the upper receiver may include mounting the gas tube to firearm. Mounting the gas tube to the firearm may comprise positioning the gas tube about the barrel nut and mounting the gas tube between a forward portion of the barrel and the upper receiver. In some embodiments, such as those where the barrel nut comprises a flange, mounting the gas tube to the firearm may comprise mounting a rearward portion of the gas tube to the flange of the barrel nut At block 606, one or more hand guard members may be positioned about the barrel of the firearm. The hand guard members may be oriented so that a longitudinal axis of the hand guard members is generally parallel to a longitudinal axis of the barrel. In positioning the one or more hand guard members about the barrel, a receiving channel within one or more of the hand guard members may be positioned to receive the barrel nut. For example, in one embodiment, an annular receiving channel can be included in a lower hand guard member to receive the cylindrically shaped outer surface of the barrel nut.

Block 606 may be followed by block 608. At block 608, at least some of the hand guard members may be coupled together to form a hand guard. In some embodiments, each hand guard member may be coupled to each adjacent hand guard member such that the hand guard members form a relatively continuous hand guard enclosing at least a portion of the circumference of the barrel. In other embodiments, only some of the adjacent hand guard members may be coupled together. In still other embodiments, none of the hand guard members may be coupled together, in which case block 608 may be omitted from the method 600 completely.

The hand guard members may be coupled together in a variety of manners. For example, fasteners such as screws may be passed through passages on some of the hand guard members into threaded couplings on other hand guard members such that the hand guard members become securely coupled together. Alternatively, the hand guard members may have snap fittings or pressure fittings that engage each other to couple the hand guard members together. In other embodiments, coupling at least some of the hand guard members together may also include or be followed by adapting hand guard members to withstand vibration, such as by adapting the couplings to receive one or more threaded inserts.

Block 608 may be followed by block 610. In block 610, at least one of the hand guard members may be secured to the barrel nut while the barrel nut is nested in the receiving channel. Securing the hand guard member to the barrel nut may comprise clamping a connector on the hand guard member about a portion of the barrel nut. More specifically, a clamping force may be applied to the connector and the barrel nut. The clamping force may be applied in a direction that is generally parallel to a longitudinal axis of the barrel. In one embodiment, a set screw can be used to apply the clamping force. The set screw may be moved through a threaded coupling in the hand guard member to force a lateral rear face of the barrel nut against a lateral rearward rim of the connector. In other embodiments, the hand guard member may be secured to the barrel nut in other manners. In some embodiments, each hand guard member is secured to the barrel nut, while in other embodiments, some of the hand guard members may not be secured to the barrel nut. The method ends after block 610.

It should be noted that the order of some of the blocks of the method 600 may be altered in some embodiments. For example, the order of block 608 and block 610 may be reversed, so that at least one of the hand guard members are secured to the barrel nut before the hand guard members are coupled together.

While particular embodiments of systems and methods associated with a barrel nut and hand guard assembly for a firearm have been disclosed in detail for purposes of example, those skilled in the art will understand that variations and modifications may be made without departing from the scope of the disclosure. All such variations and modifications are intended to be included within the scope of the present disclosure, as protected by the following claims.

The claimed invention is:

1. A hand guard assembly for a firearm, the firearm having a barrel and an upper receiver with a rail platform, the hand guard assembly comprising:

a barrel nut operable to mount the barrel to the upper receiver;

a plurality of hand guard members comprising at least an upper hand guard member and a lower hand guard member, wherein at least one of the plurality of hand guard members defines at least a portion of a receiving channel about an interior portion of the plurality of hand guard members, the receiving channel being sized and shaped to receive the barrel nut;

a coupling mechanism configured to couple at least some of the plurality of hand guard members together about the barrel;

a securing mechanism configured to secure at least one of the plurality of hand guard members to the barrel nut, wherein the securing mechanism comprises a fastener operable to apply a clamping force in a direction generally parallel to a longitudinal axis of the firearm against a lateral face of the barrel nut to capture the barrel nut between the fastener and a lateral rim of the receiving channel; and a rail platform extending forward from a rearward edge of the upper hand guard member and providing a relatively continuous mounting platform with the rail platform on the upper receiver when at least one of the plurality of hand guard members is secured to the barrel nut.

2. The hand guard assembly of claim 1, wherein the barrel nut is sized and shaped to fit wholly within the receiving channel.

3. The hand guard assembly of claim 1, wherein the receiving channel is sized and shaped to encapsulate the barrel nut.

4. The hand guard assembly of claim 1, wherein:

the barrel nut comprises a substantially cylindrical ring shape; and the receiving channel comprise a substantially annular channel shape.

5. The hand guard assembly of claim 1, wherein:

the barrel nut comprises a longitudinal outer surface; and the receiving channel comprises a longitudinal inner surface positioned in close proximity to the outer surface of the barrel nut when the barrel nut is within the receiving channel to limit movement of the hand guard in a radial direction.

6. The hand guard assembly of claim 1, wherein:

the barrel nut comprises a longitudinal outer surface; and the receiving channel comprises a longitudinal inner surface positioned in close proximity to the outer surface of the barrel nut when the barrel nut is within the receiving channel to limit movement of the plurality of hand guard members in a radial direction.

7. The hand guard assembly of claim 1, wherein:

the barrel nut comprises forward and rearward lateral faces; and the receiving channel comprises forward and rearward lateral rims extending about portions of the lateral faces of the barrel nut when the barrel nut is in the receiving channel to limit movement of the plurality of hand guard members in a longitudinal direction.

8. The hand guard assembly of claim 7, wherein the coupling mechanism is adapted to withstand vibration.

9. The hand guard assembly of 1, wherein at least one of the plurality of hand guard members comprises at least one rail platform on at least a portion of an exterior surface of at least one of the plurality of hand guard members.

10. A method for installing a hand guard on a firearm, the firearm having an upper receiver and a barrel, the method comprising:

positioning a hand guard about the barrel such that a receiving channel about an interior portion of the hand guard receives a barrel nut, the barrel nut being operable to mount the barrel to the upper receiver; and securing the hand guard to the barrel nut with a fastener operable to apply a clamping force in a direction generally parallel to a longitudinal axis of the firearm against a lateral face of the barrel nut to capture the barrel nut between the fastener and a lateral rim of the receiving channel, wherein positioning the hand guard about the barrel forms a generally continuous mounting profile with the upper receiver.

11. The method of claim 10, wherein positioning the hand guard about the barrel forms an air gap about the barrel.

* * * * *